US006454524B1

(12) United States Patent
Okada et al.

(10) Patent No.: US 6,454,524 B1
(45) Date of Patent: Sep. 24, 2002

(54) VACUUM PUMP AND VACUUM APPARATUS

(75) Inventors: Takashi Okada; Manabu Nonaka; Takashi Kabasawa, all of Narashino (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/354,873

(22) Filed: Jul. 16, 1999

(30) Foreign Application Priority Data

Jul. 21, 1998 (JP) ..... 10-222342

(51) Int. Cl.[7] ..... F01D 1/36
(52) U.S. Cl. ..... 415/90; 415/50; 415/116
(58) Field of Search ..... 415/90, 116, 49, 415/50, 13; 417/423, 4, 53

(56) References Cited

U.S. PATENT DOCUMENTS

| | | | | | |
|---|---|---|---|---|---|
| 4,699,570 | A | | 10/1987 | Bohn | 417/6 |
| 4,929,151 | A | * | 5/1990 | Long et al. | 415/90 |
| 5,209,631 | A | * | 5/1993 | Bernhardt | 415/90 |
| 5,443,368 | A | * | 8/1995 | Weeks et al. | 415/90 |
| 5,707,213 | A | * | 1/1998 | Conrad | 417/53 |
| 5,900,537 | A | * | 5/1999 | Bohm et al. | 73/40.7 |
| 6,030,181 | A | * | 2/2000 | Conrad | 417/53 |
| 6,030,189 | A | * | 2/2000 | Bohm et al. | 415/90 |

FOREIGN PATENT DOCUMENTS

| | | | |
|---|---|---|---|
| EP | 0343914 | | 11/1989 |
| JP | 58-67998 | | 5/1983 |
| JP | 58-67999 | | 5/1983 |
| JP | 63280894 | | 11/1988 |
| JP | 01167496 | | 7/1989 |
| JP | 1118190 | | 8/1989 |
| JP | 01244194 | | 9/1989 |
| JP | 02259297 | | 10/1990 |
| JP | 3107599 | | 5/1991 |
| JP | 4-1481 | | 1/1992 |
| JP | 07-027089 | * | 1/1995 |
| JP | 8-68389 | | 3/1996 |
| JP | 8189495 | | 7/1996 |
| JP | 09251981 | | 9/1997 |
| WO | 97015760 | | 5/1997 |
| WO | 99004325 | | 1/1999 |

OTHER PUBLICATIONS

Patent Abstracts of Japan, vol.007, No.230 (M–249), Oct. 12, 1983 publication No. 58124079, publication date Jul. 23, 1983.

Patent Abstracts of Japan, vol.1995, No.06, Jul. 31, 1995 publication No.07058032, publication date Mar. 3, 1995.

* cited by examiner

*Primary Examiner*—Edward K. Look
*Assistant Examiner*—Richard Woo
(74) *Attorney, Agent, or Firm*—Adams & Wilks

(57) ABSTRACT

A vacuum pump and a vacuum apparatus are provided in which gas suction and discharge force can be adjusted without producing dust. The vacuum apparatus includes a vacuum pump 1 for sucking and discharging gas within a chamber 90. The vacuum pump 1 is provided with a communicating pipe 85 that pierces the casing for communicating between the outside of the apparatus and the rotor blades and the stator blades of the turbomolecular pump section. An inert gas is supplied to the turbomolecular pump section through the communicating pipe 85 so that the inert gas is mixed with the gas that has sucked from the chamber 90. The communicating pipe 85 includes a valve 86, and an open/close operation of the valve 86 is controlled in accordance with an output from a pressure sensor 97 witnin the chamber 90. An amount of the inert to be supplied to the turbomolecular pump section T and then mixed, is adjusted by the valve 86 so that a pressure within the vacuum pump 1 is adjusted, with the result that a gas suction force from the chamber 90 can be adjusted.

12 Claims, 7 Drawing Sheets

PRIOR ART

PRIOR ART

VACUUM PUMP AND VACUUM APPARATUS

BACKGROUND OF THE INVENTION

1. Field of the Invention

The present invention relates to a vacuum pump and a vacuum apparatus, and more specifically, to a vacuum pump and a vacuum apparatus which can adjust a pressure within a vacuum container.

2. Description of the Related Art

Upon manufacturing a semiconductor or a liquid crystal, in the case where dry etching, CVD, etc., are performed, a vacuum apparatus is used in which a process gas is introduced into a chamber and the process gas is discharged with a vacuum pump.

FIG. 7 shows a turbomolecular pump as an example of the vacuum pump conventionally used.

As shown in FIG. 7, the vacuum pump (turbomolecular pump) has stator blades and rotor blades which are disposed on a stator portion and a rotor portion, respectively, in multistage arrangement in an axial direction. The rotor portion is rotated with a motor at high speed so that the exhaust (vacuum) action is performed from an inlet port side (on the upper side of the drawing) to an outlet port side (on the left and lower side of the drawing).

FIG. 8 shows an outline of the conventional vacuum apparatus in which such a vacuum pump is disposed in relation to a chamber.

As shown in FIG. 8, in the conventional vacuum apparatus, a stage 92 on which a sample 91, etc., are placed is provided within a chamber (container) 90. Also, provided outside the chamber 90 is a drive mechanism 93 for rotating the stage 92 or for performing other functions from the downside of the stage 92. A turbomolecular pump 95 is mounted from the outside of the chamber 90 onto a portion of an outlet port 94 provided at the lower surface (or side surface) of the chamber so as to discharge the gas existing within the chamber 90.

As shown in FIG. 3, in the conventional vacuum apparatus, the outlet port of the chamber 90 and the inlet port of the vacuum pump 95 communicate via a conductance variable valve 96. Accordingly, the amount of process gas to be exhausted from the chamber 90 is adjusted by changing a conductance of the conductance variable valve 96, to thereby control the pressure within the chamber 90 to a predetermined level.

However, in the conventional vacuum apparatus described above, since the conductance variable valve 96 is directly communicated with the exhaust port 94 of the chamber 90, there is a concern that dust produced upon the operation or the like of the conductance variable valve 96 would be caused into flow backward into the chamber 90. The occurrence of dust is an important problem to be particularly avoided in the production of a semiconductor or liquid crystal.

SUMMARY OF THE INVENTION

The present invention has been made to solve the above-mentioned problem inherent in the conventional vacuum apparatus, and therefore has a primary object of the invention to provide a vacuum pump in which an adjustment of a suction/discharge force can be made without producing dust, Further, a secondary object of the present invention is to provide a vacuum apparatus in which an adjustment of a pressure within a vacuum container can be made without producing dust.

In order to attain the primary object of the present invention, there is provided a vacuum pump, comprising: an inlet port for sucking a first gas from outside; a gas feed section for feeding the first gas sucked from the inlet port; an outlet port for discharging the gas within the gas feed section; a pressure changing means for changing the pressure within the gas feed section; and a control means for controlling the change of pressure changed by the pressure changing means.

According to the vacuum pump of the present invention, the pressure within the gas feed section can be changed with the pressure changing means, thereby being capable of changing a suction force for sucking gas from the inlet port. Accordingly, an adjustment of the suction force for sucking gas can be made without providing a valve between the container from which the gas is to be sucked. As a result, contamination of the container by dust occurring from the valve can be avoided.

The vacuum pump of the present invention may employ such a structure that the pressure changing means includes a gas mixing means for mixing a second gas with the first gas that is feeding at the gas feed section, and the control means controls the amount of the second gas mixed by the gas mixing means.

In addition, the vacuum pump of the present invention may employ such a structure that it further comprises an auxiliary pump for sucking the first gas discharged from the outlet port, wherein the pressure changing means includes a conductance variable valve provided between the outlet port and the auxiliary pump, and the control means controls a conductance of the conductance variable valve.

In order to attain the secondary object of the present invention, according to the present invention, there is provided a vacuum apparatus, comprising: the vacuum pump; and the container from which the gas is to be sucked and discharged with the vacuum pump.

In this case, it preferably has a structure in which the vacuum apparatus further comprises a pressure sensor for detecting the pressure within the container, and the control means decides an amount to be controlled in accordance with an output from the pressure sensor.

DETAILED DESCRIPTION OF THE PREFERRED EMBODIMENTS

Hereinafter, detailed descriptions will be made of the preferred embodiments of the present invention with reference to FIG. 1 to FIG. 6.

Figure 1:
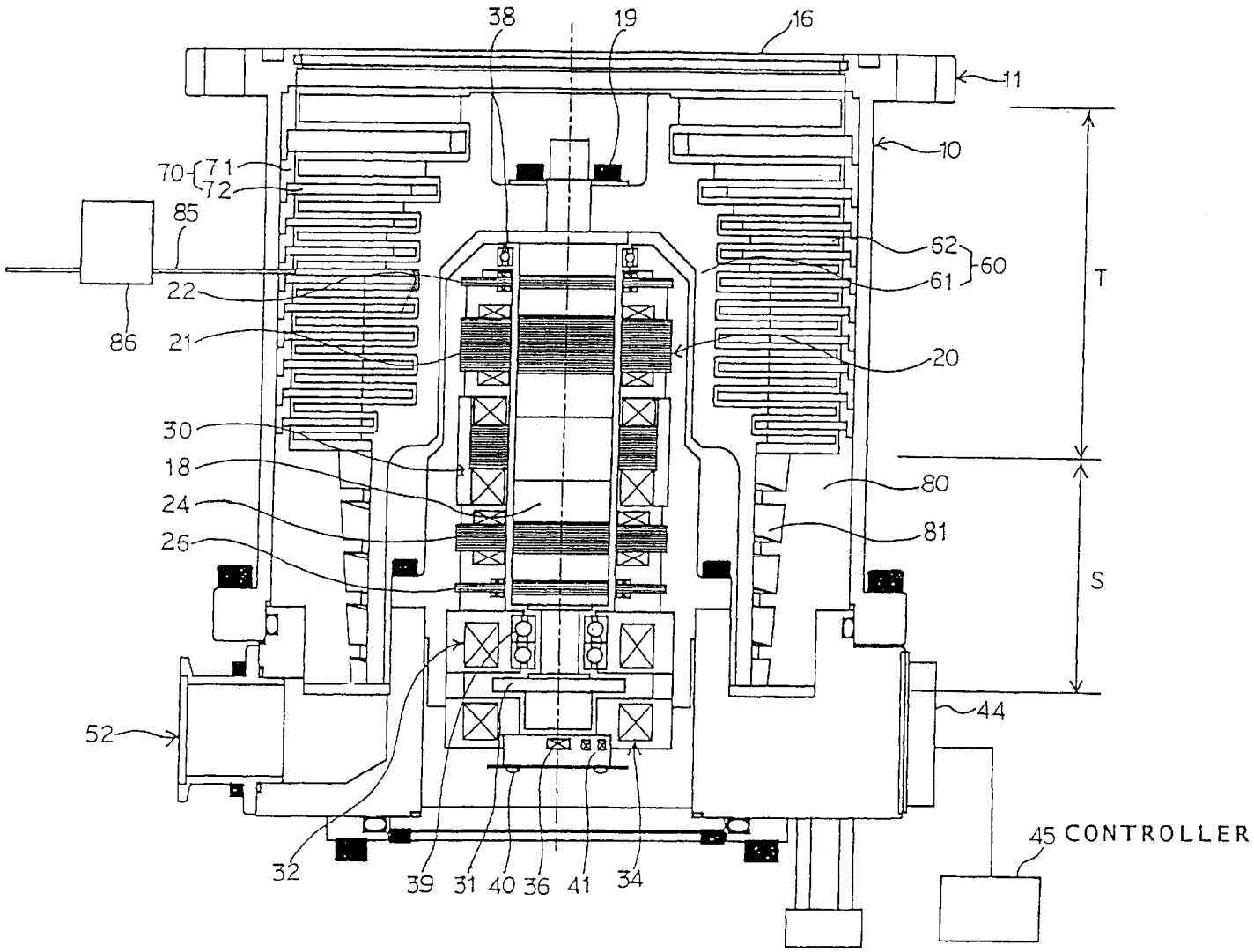
FIG. 1 is a cross-sectional view showing the entire structure of a vacuum pump according to an embodiment of the present invention.

FIG. 1 is a cross-sectional view showing the entire structure of a vacuum pump according to an embodiment of the present invention.

The vacuum pump 1 is installed, for example, in a semiconductor manufacturing equipment for exhausting a process gas from a chamber, etc. The vacuum pump 1 is provided with a turbomolecular pump section T in which a stator blade 72 and a rotor blade 62 cooperate with each other to feed the process gas from the chamber, etc. to the downstream side, and a thread groove pump section S to which the process gas is supplied from the turbomolecular pump section T and in which a thread groove pump allows the supplied process gas to be further fed for exhaustion.

As shown in FIG. 1, the vacuum pump 1 comprises a casing 10 that is substantially tubular, a rotor shaft 18 that is substantially cylindrical and is arranged at the center portion of the casing 10, a rotor 60 fixedly provided at the rotor shaft 18 and rotated with the rotor shaft 18, and a stator 70.

The casing 10 has a flange 11 at a top end portion extending outward in a radial direction, such that the flange 11 is secured to the semiconductor manufacturing equipment or the like with bolts or the like so as to connect an inlet port 16 formed inside of the flange 11 with an exhaust port of a container such as a chamber to communicate the inner portion of the container and the inner portion of the casing 10 with each other.

Figure 2:
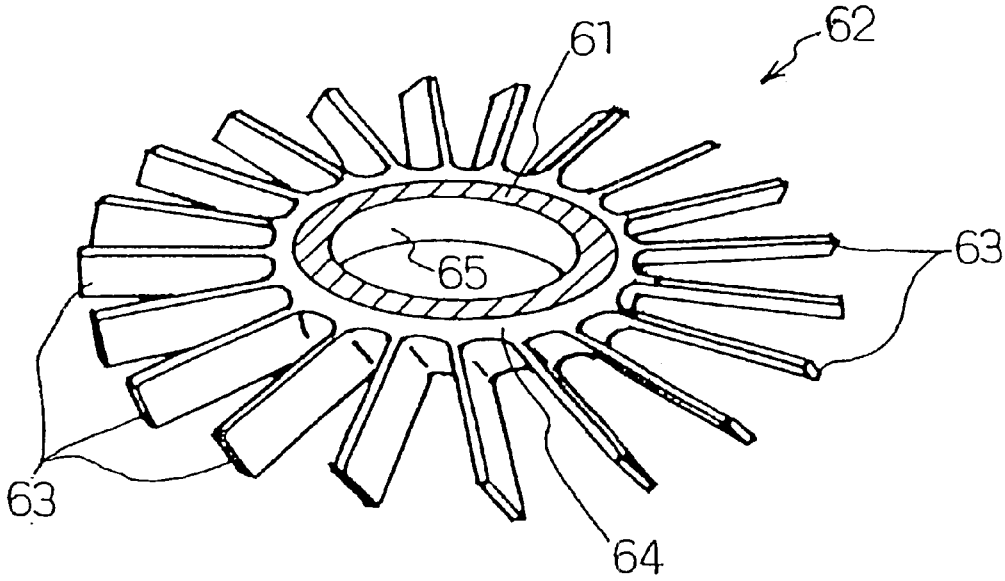
FIG. 2 is a sectional perspective view showing a rotor in the vacuum pump of FIG. 1 which is cut along upper and lower planes of a rotor blade.

FIG. 2 is a sectional perspective view showing the rotor 60 that is cut along upper and lower planes of the rotor blade 62.

The rotor 60 is provided with a rotor body 61 having a substantially inverted U-shape in cross-section which is arranged to the outer periphery of the rotor shaft 18. The rotor body 61 is attached to the top portion of the rotor shaft 18 with bolts 19. In the turbomolecular pump section T, rotor ring portions 64 are formed in a multistage manner around the outer periphery of the rotor body 61. As shown in FIG. 2, rotor blades 62 are annularly arranged to the respective rotor ring portions 64. The rotor blades 62 at the respective stages include a plurality of blades (vane) 63 with an open end.

In the turbomolecular pump section T, the stator 70 is composed of spacers 71 and stator blades 72 that are arranged between the rotor blades 62 at the respective stages, while being supported at their outer circumferential sides between the spacers 71 and 71. The thread groove pump section S includes thread groove section spacers 80 communicating with the spacers 71.

The spacers 71 each are a tubular shape having stepped portions, and are accumulated within the casing 10. The length of each stepped portion in an axial direction, which is located inside of the respective spacers 71, varies in correspondent with the intervals between the respective stages of the rotor blades 62.

Figure 3:
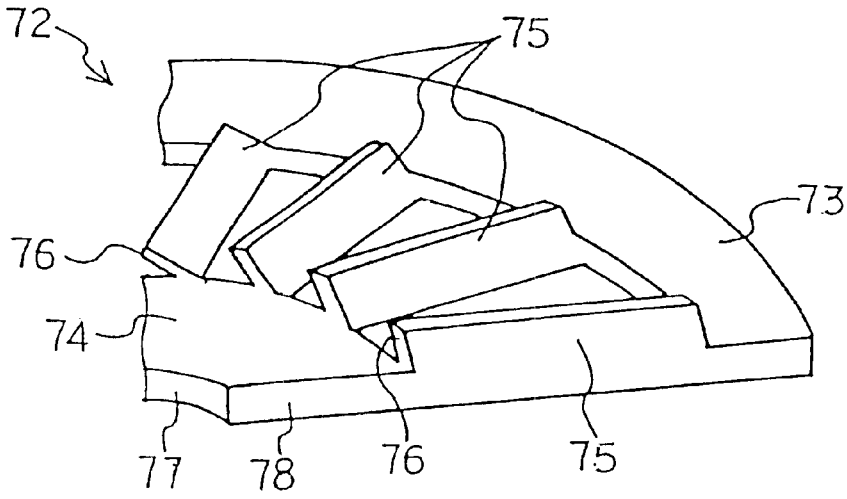
FIG. 3 is a perspective view showing a part of a stator blade in the vacuum pump of FIG. 1.

FIG. 3 is a perspective view showing a part of the stator blade.

The stator blade 72 is composed of an outer ring portion 73 forming part an outer circumferential portion of which is sandwiched by the spacers 71 in the circumference direction, an inner ring portion 74, and a plurality of stator blades 75 both ends of which are supported radially with a predetermined angle by the outer ring portion 73 and the inner ring portion 74. The inner diameter of the inner ring portion 74 is formed to have a larger size than the outer diameter of the rotor body 61 so that an inner circumferential surface 77 of the inner ring portion 74 and an outer circumferential surface 65 of the rotor body 61 do not contact with each other.

In order to arrange the stator blades 72 between the rotor blades 62 at the respective stages, each stator blade 72 is divided into two parts in circumference. The stator blade 72 is made from a thin plate such as a stainless or aluminum thin plate that is divided into two. An outer portion having a semi-ring profile and portions for blades 75 of the stator blade 72 are cut out by means of etching from the thin plate, and the portions for blades 75 are folded by means of press machining to have a predetermined angle. Thus, the shape shown in FIG. 3 is obtained.

The stator blades 72 at the respective stages are sandwiched in a circumferential direction at the outer ring portion 73 between the respective stepped portions of the spacers 71 and 71, respectively, thereby being retained between the rotor blades 62.

As shown in FIG. 1, the thread groove section spacers 80 are arranged inside the casing 10, while being communicated with the spacers 71, and are placed beneath the spacers 71 and the stator blades 72. The thread groove section spacer 80 has a thickness so that its inner diameter wall extends up to a position that comes to close contact with the outer circumferential surface of the rotor body 61. A plurality of thread grooves 81, each having a spiral structure, are formed in the inner diameter wall. The thread grooves 81 are communicated with spaces between the stator blades 72 and the rotor blades 62 so that the gas that has fed and discharged may be introduced into the thread grooves 81.

It should be noted that in this embodiment, whiles the thread grooves 81 are formed on the side of the stators 70 the thread grooves 81 may instead be formed in an outer diameter wall of the rotor body 61. In addition, the thread grooves 81 may alternatively be formed in the thread groove section spacer 80 as well as in the outer diameter wall of the rotor body 61.

The turbomolecular pump 1 further includes a magnetic bearing 20 for supporting the rotor shaft 18 with magnetic force, a motor 30 for generating torque to the rotor shaft 18, and a circuit board receiving section 40 for receiving a circuit board.

The magnetic bearing 20 uses a five-directional-control, and includes radial electromagnets 21 and 24 for generating magnetic force in a radial direction which respect to the rotor shaft 18, radial sensors 22 and 26 for detecting the position of the rotor shaft 18 in a radial direction, axial electromagnets 32 and 34 for generating magnetic force in an axial direction which respect to the rotor shaft 18, a metal disk 31 on which force generated by the axial electromagnets 32 and 34 is acted, and an axial sensor 36 for detecting, from the inside of the circuit board receiving section 40, the position of the rotor shaft 18 in an axial direction.

The radial electromagnet 21 is composed of two pairs of electromagnets that are disposed so as to be orthogonal with each other. The respective pairs of electromagnets are disposed at a position higher than the motor 30 of the rotor shaft 18, while sandwiching the rotor shaft 18 therebetween.

Provide at an upper portion of the radial electromagnet 21 are two pairs of radial sensors 22 facing each other and sandwiching the rotor shaft 18 therebetween. Two pairs of the radial sensors 22 are disposed so as to cross at right angles with each other in correspondence with two pairs of the radial electromagnets 21.

Furthermore, two pairs of electromagnets 24 are similarly disposed at a position lower than the motor 30 of the rotor shaft 18 so as to be orthogonal with each other.

Below the radial electromagnet 24 and the motor 30, two pairs of the radial sensors 26 are similarly provided so as to be adjacent to the radial electromagnet 24.

By supplying an excitation current to these radial electromagnets 21 and 24, the rotor shaft 18 is magnetically levitated. This excitation current is controlled in accordance with the position detection signals from the radial sensors 22 and 26 upon the magnetic levitation. As a result, the rotor shaft 18 is secured at the prescribed position in the radial direction.

Onto the lower portion of the rotor shaft 18, a discoid metal disk 31 formed of a magnetic substance is fixed. Each pair of axial electromagnets 32 and 34 facing each other are disposed while sandwiching this metal disk 31 therebetween. Further, the axial sensors 36 are disposed facing each other at the lower end portion of the rotor shaft 18.

The excitation currents of the axial electromagnets 32 and 34 are controlled in accordance with the position detection signal from the axial sensor 36. As a result, the rotor shaft 18 is secured at the prescribed position in the axial direction.

The magnetic bearing 20 includes a magnetic bearing controlling section disposed within a controller 45 for magnetically levitating the rotor shaft 18 by feedback controlling the excitation current of the radial electromagnets 21 and 24 and the axial electromagnets 32 and 34, respectively, on the basis of the detection signals of these radial sensors 22 and 26 and the axial sensor 36.

Employment of the magnetic bearing prevents dust from occurring, because it eliminates a mechanical contacting portion. In addition, since oil for sealing, etc., can be dispensed with, generation of gas is prevented, thus being capable of operating under a clean environment. The apparatus using the magnetic bearing is suitable for the case where high degree of cleanness is required, such as when manufacturing a semiconductor.

The touch down bearings 38 and 39 are disposed a the upper and lower sides of the rotor shaft 18.

In general, the rotor portion consisting of the rotor shaft 18 and respective portions attached thereto is axially supported in a non-contact state by the magnetic bearing 20, during its rotation with the motor 30. The touch down bearings 38 and 39 play a part for protecting the entire device by axially supporting the rotor portion in place of the magnetic bearing 20 when touch down occurs.

Accordingly, the touch down bearings 38 and 39 are arranged so that the inner race of the bearings 38 and 39 are in the non-contact state against the rotor shaft 18.

The motor 30 is disposed between the radial sensor 22 and the radial sensor 26 inside the casing 10, substantially at the center position of the rotor shaft 18 in the axial direction. The rotor shaft 18, the rotor 60 and the rotor blades 62 fixed thereto are allowed to rotate by applying a current to the motor 30. An r.p.m. of the rotation is detected by an r.p.m. sensor 41 within the circuit board receiving section 40, and is controlled on the basis of signals from the r.p.m. sensor 41 by a controlling system 45.

An exhaust port 52 for exhausting the gas fed by the thread pump section S is disposed at the lower portion of the casing 10 of the vacuum pump 1.

Also, the vacuum pump is connected to the controlling system 45 through the connector 44 and the cable.

Further, the vacuum pump 1 according to the embodiment of the present invention is provided with a communicating pipe 85 that pierces the casing 10 for communicating between the outside of the apparatus and the rotor blades 62 and the stator blades 72. An inert gas is supplied to the turbomolecular pump section T through the communicating pipe 85 so that the inert gas is mixed with the gas that has been sucked and fed. The communicating pipe 85 includes a conductance variable valve 66 (hereinafter referred to as "valve"), and an adjustment of an amount of the inert gas to be supplied to the turbomolecular pump section T, and then mixed, is effected by the valve 86.

The valve 86 is configured to open and shut a shutter with a valve motor, and the valve motor is controlled by the signal from the control system 45.

Figure 8:
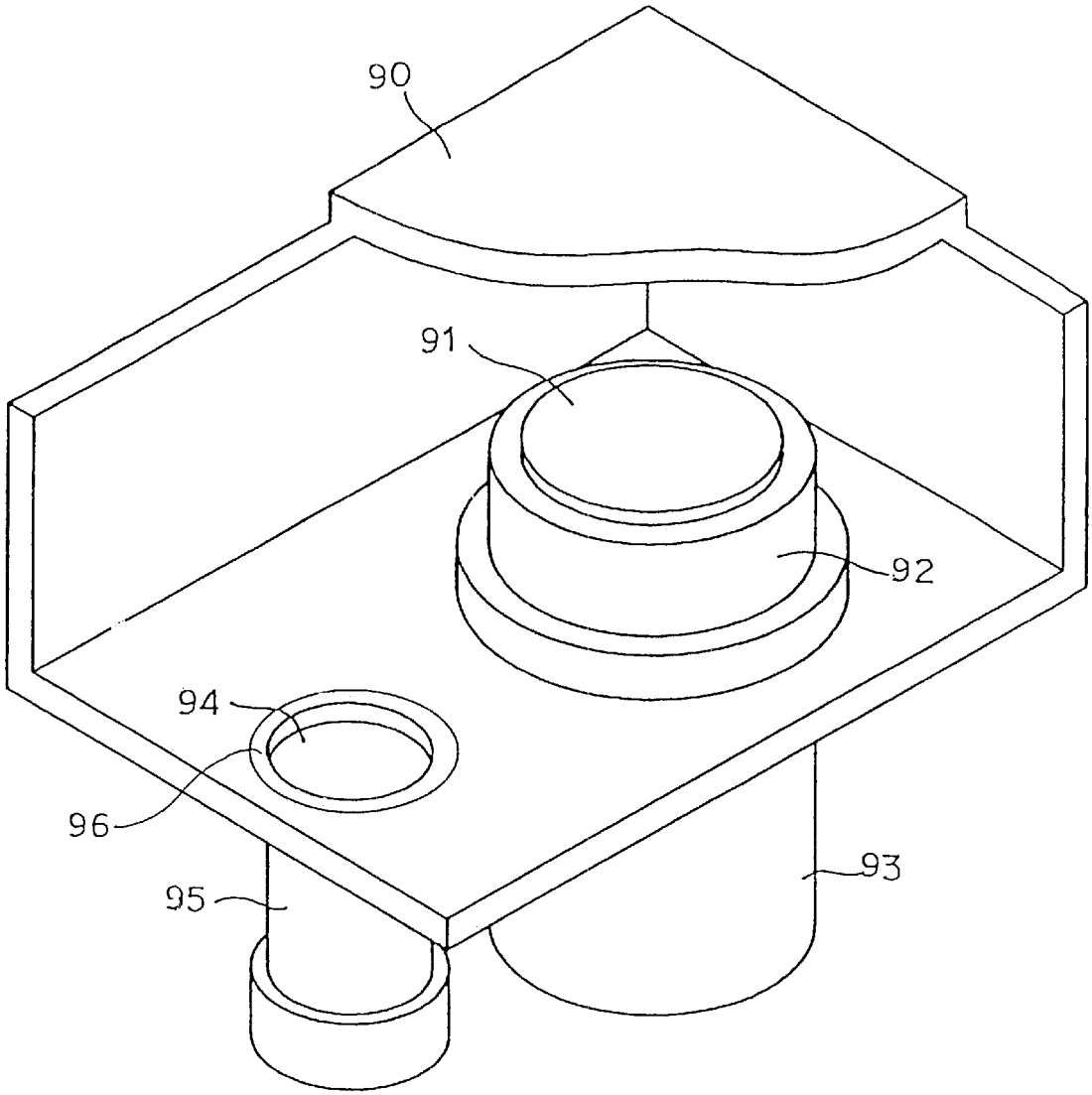
FIG. 8 is a perspective view showing an outline of the conventional vacuum apparatus.

Now a description will be made of an embodiment of a vacuum apparatus according to the present invention, in which the vacuum pump according to the above embodiment of the present invention is employed. Note that in this embodiment, the same reference numerals are used to illustrate the identical components as in the conventional vacuum apparatus shown in FIG. 8, and detailed descriptions thereof are omitted.

Figure 4:
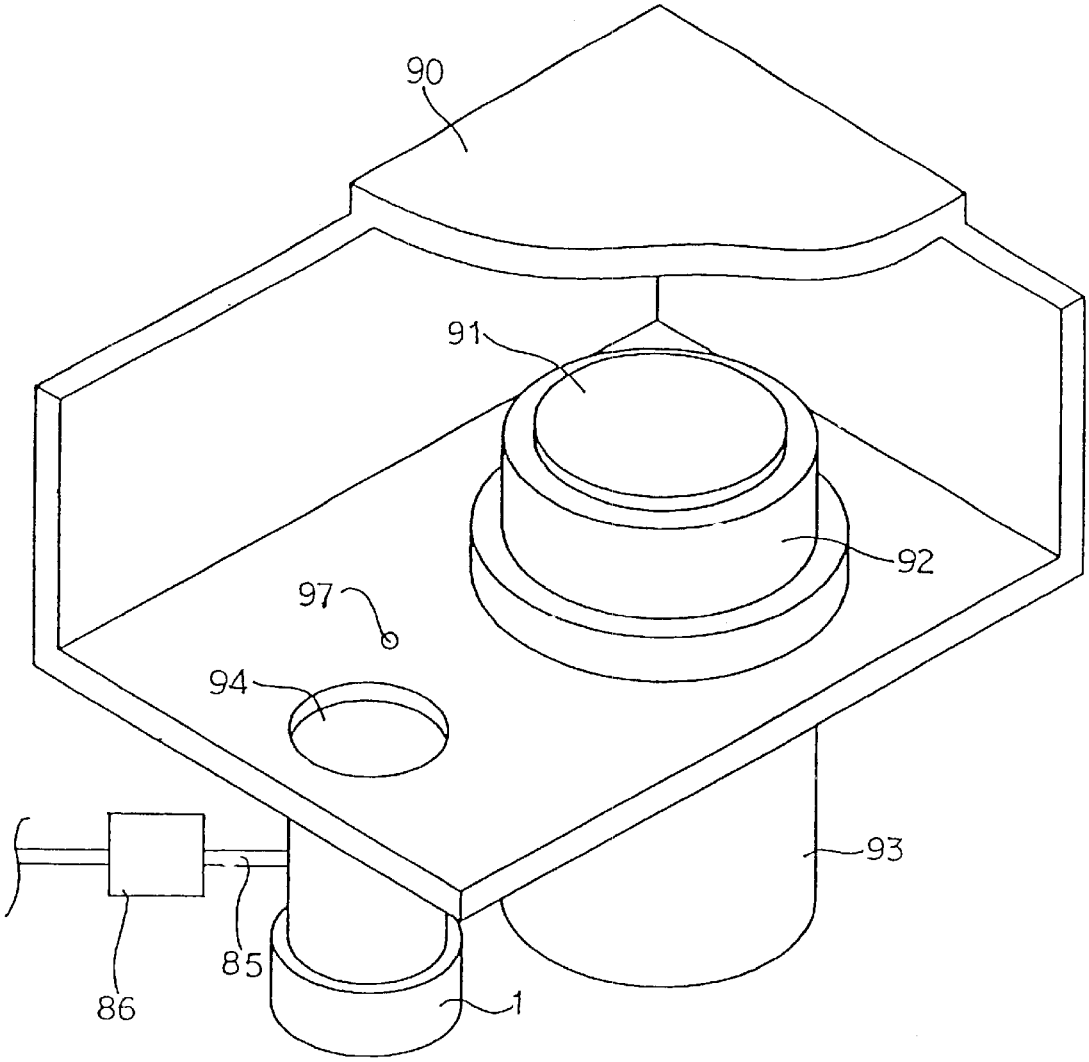
FIG. 4 is a schematic perspective view showing the structure of a vacuum apparatus according to an embodiment of the present invention.

FIG. 4 is a schematic perspective view showing the structure of a vacuum apparatus according to an embodiment of the present invention.

As shown in FIG. 4, in the vacuum apparatus of this embodiment, a pressure sensor 97 is provided within the chamber 90 for detecting the pressure within the chamber.

The pressure sensor 97 is connected to the control system 45 via the connector and cable so that a signal corresponding to the pressure from the pressure sensor 37 is output to the control system 45.

Further, in the vacuum apparatus, the vacuum pump 1 is directly mounted to the outlet port 94 of the chamber 90 without the valve therebetween.

In the vacuum pump 1 and the vacuum apparatus thus structured, the rotor 60 is rotated at high speed of a rated value (20,000 to 50,000 r.p.m.) with the motor 30 so that the rotor blades 62 also rotate at high speed. With this, the process gas, etc., within the chamber 90 are fed by the rotor blades 62 and the thread grooves 81 via the outlet port 94 and the inlet port 16 of the vacuum pump 1, and are discharged from the outlet port 52.

Figure 5:
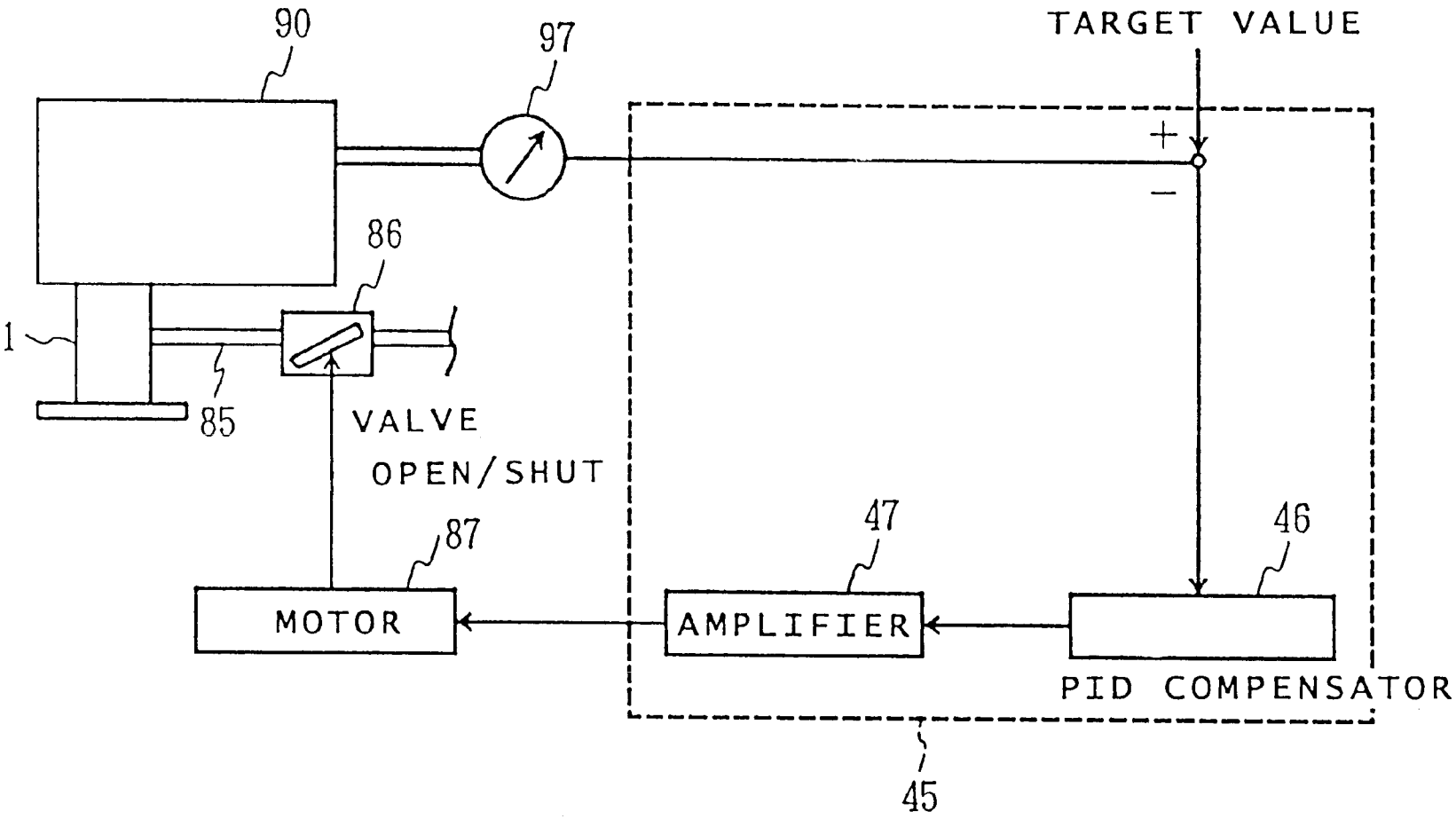
FIG. 5 is a block diagram showing a control system for a pressure within a chamber in the vacuum apparatus of FIG. 4.

FIG. 5 is a block diagram showing a control system for a pressure within the chamber 90 in the vacuum apparatus of this embodiment.

As shown in FIG. 5, a signal from the chamber 90, corresponding to the pressure therein is outputted to the control system 45. After the comparison with a target value, in the control system 45, the difference therebetween is output to a PID compensation unit 46. In the PID compensation unit 46, a control signal corresponding to the difference between the target value is output. The control signal is output to a valve drive motor 87 after amplified by an amplifier 47.

Then, the valve drive motor 87 is driven in accordance with the input signal so that the open and shut operation of the valve 86 is performed.

In the case where the pressure in the vicinity of the pressure sensor 97 is low, an opening of the valve 86 is enlarged in accordance with the signal from the control system 45 so as to increase the amount of inert gas to be introduced from the communicating pipe 85, with the result that the pressure within the turbomolecular section T is raised. For that reason, the pressure at the inlet port 16 is raised, too, and the suction force for evaluating the gas within the chamber 90 is reduced. As a result, the pressure within the chamber 90 is raised.

In the case where the pressure in the vicinity of the pressure sensor 97 is high, the opening of the valve 136 is narrowed so as to decrease the amount of inert gas to be introduced from the communicating pipe 85. Since the amount of gas to be exhausted by the pumping action is not changed, the pressure within the turbomolecular pump section T is lowered. For that reason, the pressure at the inlet port 16 is also reduced, and the suction force for sucking the gas within the chamber 90 is increased. As a result, the pressure within the chamber 90 is lowered.

Figure 6:
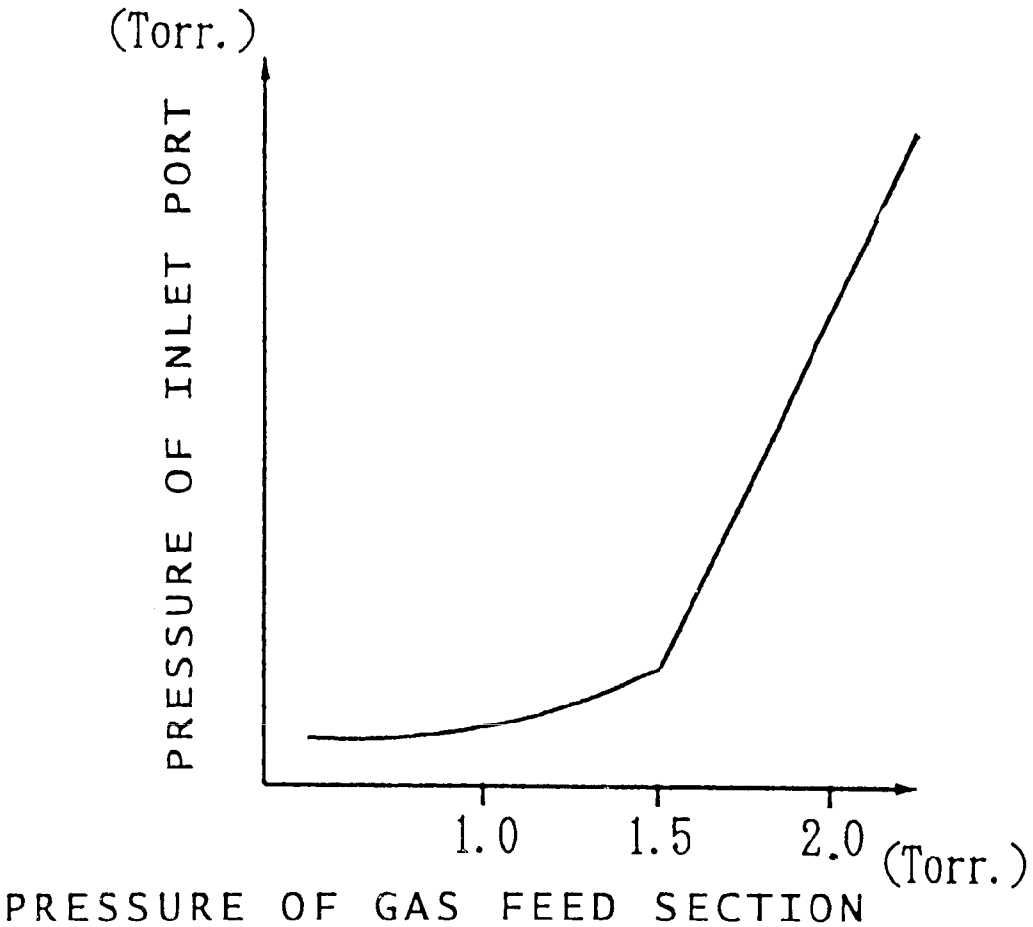
FIG. 6 is a graph illustrating a relation between an atmospheric pressure within a gas feed section in the vacuum pump and an atmospheric pressure at an inlet port.
Figure 7:
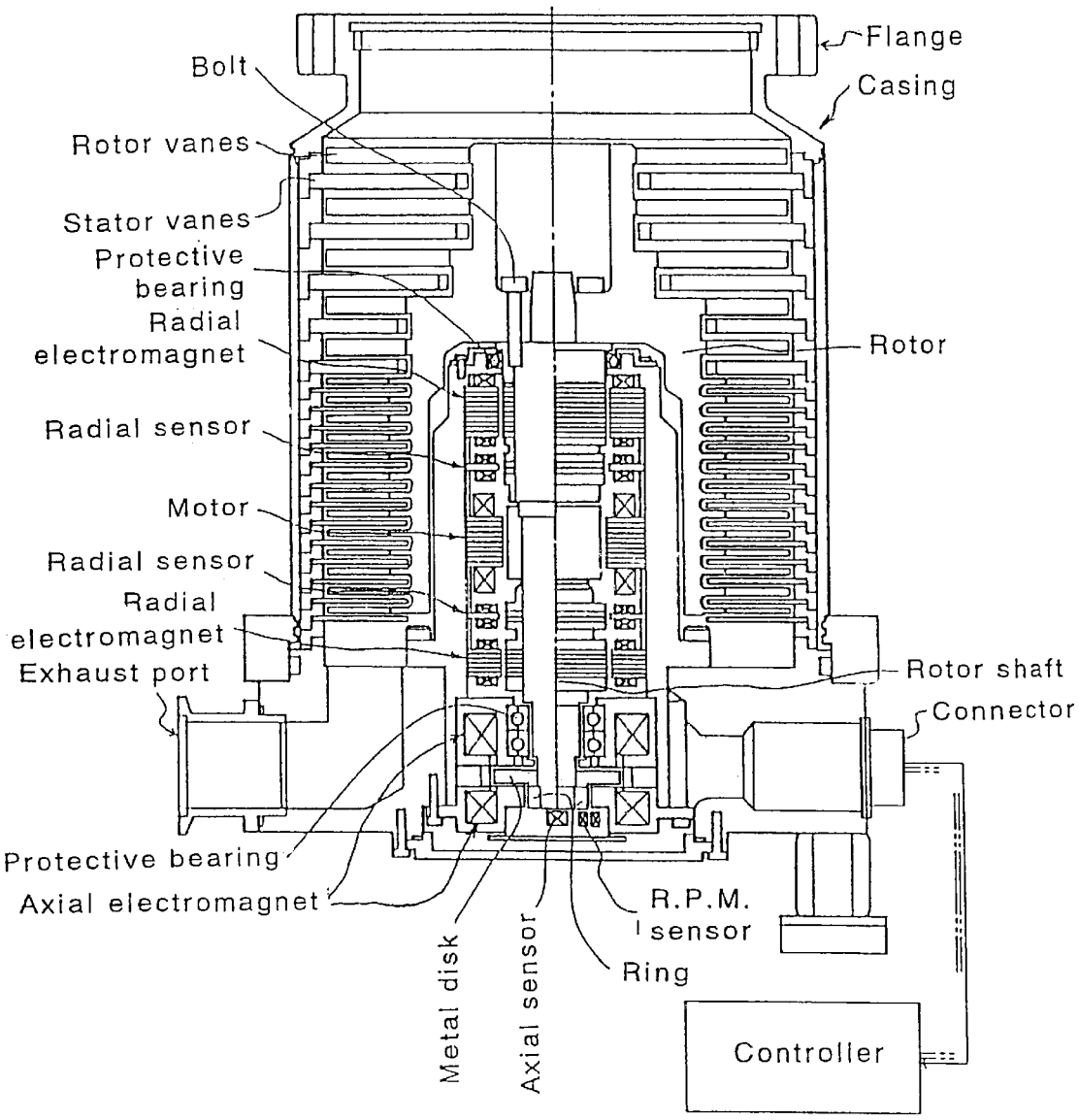
FIG. 7 is a cross-sectional view showing the structure of a turbomolecular pump used as an example of the conventional vacuum pump.

FIG. 6 is a graph illustrating a relation between an atmospheric pressure within the gas feed section (gas passage of the turbomolecular pump section T and thread groove pump section S) in the vacuum pump 1 and an atmospheric pressure at an inlet port 16. As described above, if the atmospheric pressure within the gas feed section of the vacuum pump 1 is raised, the pressure at the inlet port 16 also becomes high. As a result, the suction force for sucking the gas from outside is weakened. Further, if the atmospheric pressure within the gas feed section exceeds a given pressure (about 1.5 to 2.0 Torr), the pressure at the inlet port 16 is also raised due to an elevation of the atmospheric pressure within the gas feed section. As a result, it becomes possible to effectively adjust the suction force of the vacuum pump 1, particularly at the atmospheric pressure higher than the given pressure.

As described above, according to this embodiment of the present invention, an inert gas is introduced into the turbomolecular pump section T, and a mixing amount of the inert gas to be mixed with the gas from the chamber 90 is controlled to thereby control the pressure within the chamber 90. Accordingly, according to this embodiment, a valve or the like serving as a component for adjusting the gas suction/discharge amount is not required. As a result, there is no fear that dust caused by such components would flow backward to the chamber 90.

Further, according to this embodiment, the pressure sensor 97 for detecting the pressure within the chamber 90 is provided, and the open/shut amount of the valve 86 is determined on the basis of the output from the pressure sensor 97 to thereby control the amount of inert gas to be mixed. As a result, the pressure within the chamber 90 can be effectively adjusted without-problems to a desired value.

It should be noted that the vacuum pump of the present invention and the vacuum apparatus of the present invention shall not be construed to be limited to the embodiments described above, and can be appropriately modified without departing from the gist of the present invention.

For example, in the above-mentioned embodiments, the gas feed section is constructed by the turbomolecular pump section T and the thread groove section S. However, the gas feed section is not limited thereto. For example, the gas feed section may be composed of the turbomolecular pump section T only, or a combination of the turbomolecular pump section T and a pump section other than a thread groove pump, such as a centrifugal flow pump type, or the like.

In the above-mentioned embodiments of the present invention, the inert gas as the second gas is introduced by means of the communicating pipe 85 as a mixing means. However, the present invention is not limited thereto. The second gas may be introduced into another portion such as the communicating portion between the turbomolecular pump section T and the thread groove pump section S, the thread groove pump section S, and a space in front of the outlet port 52.

Further, in the case where an auxiliary pump. is provided for evacuating the gas to be exhausted from the outlet port 52 of the vacuum pump 1, the communicating pipe 85 may be arranged so that the inert gas is mixed with the gas exhausted from the outlet port 52, and then sucked by the auxiliary pump.

In addition, in the case where the auxiliary pump is provided for sucking the gas to be exhausted from the outlet port 52 of the vacuum pump 1, it may employ such a structure that the valve is arranged as an atmospheric pressure elevating means between the outlet port 52 and the auxiliary pump without providing the communicating pipe, and the control of the gas to be sucked from the outlet port 52 to the auxiliary pump is performed by the open/close operation of the valve, to thereby elevate the atmospheric pressure within the vacuum pump 1. In this case, the position for attaching the valve is down stream of the vacuum pump 1 in view of the flow of the gas. As a result, the dust caused by the valve can be prevented from flowing backward into the chamber 90.

In the above-mentioned embodiments of the present invention, the rotor shaft 18 supported by the magnetic bearing. However, the present invention is not limited thereto, and a dynamic pressure bearing, a static pressure bearing, and other bearing may be employed in place thereof.

In the above-mentioned embodiment of the present invention, the motor of an inner rotor type is used in the vacuum pump 1. However, a motor of an outer rotor type may replace thereto.

In the above-mentioned embodiment of the present invention, though the inert gas is used as the second gas to be mixed with the first gas to be sucked and fed from the inlet port 16 of the vacuum pump 1, the second gas is not limited thereto. However, the gas is preferably one that does not adversely affect a reaction, etc., within the chamber 90, even if the gas flows backward into the chambers 90 and mixed therein. Accordingly, a purge gas and an inert gas such as nitrogen or a rare gas is preferably employed.

As described above, according to the vacuum pump and the vacuum apparatus of the present invention, the suction and discharge force of the gas can be adjusted without producing the dust.

What is claimed is:

1. A vacuum pump, comprising: an inlet port into which a first gas is pumped from a chamber to be evacuated; a gas feed section for pumping the first gas so that the gas enters the inlet port from the chamber to be evacuated and passes therethrough; an outlet port for discharging the gas pumped by the gas feed section; gas mixing means for mixing a second gas with the first gas within the vacuum pump so as to control the pressure within the chamber to be evacuated; and control means for controlling the gas mixing means when the vacuum pump is attached to the chamber to be evacuated to control the amount of the second gas to be mixed with the first gas by the gas mixing means so as to control the pressure in the chamber to have a desired value; wherein the gas feed section includes a turbomolecular pump section for pumping the first and second gasses, the turbomolecular pump section comprising plural stator blades fixed in a multi-stage manner in a gas feeding direction and respective rotor blades rotating between respective stator blades; and wherein the gas mixing means mixes the second gas with the first gas in the turbomolecular pump section.

2. A vacuum pump according to claim 1; wherein the second gas is an inert gas.

3. A vacuum pump, comprising: an inlet port into which a first gas is pumped from a chamber to be evacuated; a gas feed section for pumping the first gas so that the gas enters the inlet port from the chamber to be evacuated and passes therethrough; an outlet port for discharging the gas pumped by the gas feed section; gas mixing means for mixing a second gas with the first gas within the vacuum pump so as to control the pressure within the chamber to be evacuated; and control means for controlling the gas mixing means when the vacuum pump is attached to the chamber to be evacuated to control the amount of the second gas to be mixed with the first gas by the gas mixing means so as to control the pressure in the chamber to have a desired value; wherein the gas feed section includes a thread groove pump section for feeding the first and second gasses by rotating a rotor blade side, the thread groove pump section comprising the rotatable rotor blade side and a fixed stator blade side, at least one of the rotor blade side and stator blade side having a thread groove formed therein for feeding the gasses therethrough; and wherein the gas mixing means mixes the second gas with the first gas in the thread groove pump section.

4. A vacuum pump, comprising: an inlet port into which a first gas is pumped from a chamber to be evacuated; a gas feed section for pumping the first gas so that the gas enters the inlet port from the chamber to be evacuated and passes therethrough; an outlet port for discharging the gas pumped by the gas feed section; gas mixing means for mixing a second gas with the first gas within the vacuum pump so as to control the pressure within the chamber to be evacuated; and control means for controlling the gas mixing means when the vacuum pump is attached to the chamber to be evacuated to control the amount of the second gas to be mixed with the first gas by the gas mixing means so as to control the pressure in the chamber to have a desired value; wherein the gas feed section includes a turbomolecular pump section and a thread groove pump section leading to the turbomolecular pump section; and wherein the gas mixing means mixes the second gas with the first gas at a space between the turbomolecular pump section and the thread groove pump section.

5. A vacuum pump, comprising: an inlet port into which a first gas is pumped from a chamber to be evacuated; a gas feed section for pumping the first gas so that the gas enters the inlet port from the chamber to be evacuated and passes therethrough; an outlet port for discharging the gas pumped by the gas feed section; gas mixing means for mixing a second gas with the first gas within the vacuum pump so as to control the pressure within the chamber to be evacuated; and control means for controlling the gas mixing means when the vacuum pump is attached to the chamber to be evacuated to control the amount of the second gas to be mixed with the first gas by the gas mixing means so as to control the pressure in the chamber to have a desired value; wherein the gas feed section includes a turbomolecular pump and a thread groove pump connected to the turbomolecular pump; and wherein the gas mixing means mixes the second gas with the first gas in one of the turbomolecular pump and the thread groove pump.

6. A vacuum pump, comprising: an inlet port into which a first gas is pumped from a chamber to be evacuated; a discharge port for discharging the gas; a gas feed section for pumping the first gas from the chamber through the inlet port and out the outlet port; a gas inlet for inputting a variable amount of a second gas into the vacuum pump to be mixed with the first gas; and a pressure regulator for regulating a pressure within the chamber to be evacuated to a desired value by controlling the amount of second gas input to the vacuum pump; wherein the gas feed section comprises a turbomolecular pump for feeding the first and second gasses by rotating plural rotor blades, the turbomolecular pump comprising plural stator blades fixed in a multi-stage manner in a gas feeding direction, the respective rotor blades rotating between respective stator blades; and wherein the gas inlet mixes the second gas with the first gas in the turbomolecular pump section.

7. A vacuum pump according to claims 6; wherein the second gas is an inert gas.

8. A vacuum apparatus, comprising: a vacuum pump according to claim 6; the chamber to be evacuated by the vacuum pump; and a pressure sensor for detecting a pressure within the chamber.

9. A vacuum apparatus according to claim 8; further comprising a pressure sensor for detecting a pressure within the container; and control means for controlling the pressure regulator in accordance with an output from the pressure sensor.

10. A vacuum pump, comprising: an inlet port into which a first gas is pumped from a chamber to be evacuated; a discharge port for discharging the gas; a gas feed section for pumping the first gas from the chamber through the inlet port and out the outlet port; a gas inlet for inputting a variable amount of a second gas into the vacuum pump to be mixed with the first gas; and a pressure regulator for regulating a pressure within the chamber to be evacuated to a desired value by controlling the amount of second gas input to the vacuum pump; wherein the gas feed section comprises a thread groove pump for feeding the first and second gasses by rotating a rotor blade side, the thread groove pump section comprising the rotor blade side and a fixed stator blade side, at least one of the rotor blade side and stator blade side having a thread groove formed therein for feeding the gasses therethrough; and wherein the gas inlet mixes the second gas with the first gas in the thread groove pump section.

11. A vacuum pump, comprising: an inlet port into which a first gas is pumped from a chamber to be evacuated; a discharge port for discharging the gas; a gas feed section for pumping the first gas from the chamber through the inlet port and out the outlet port; a gas inlet for inputting a variable amount of a second gas into the vacuum pump to be mixed with the first gas; and a pressure regulator for regulating a pressure within the chamber to be evacuated to a desired value by controlling the amount of second gas input to the vacuum pump; wherein the gas feed section includes a turbomolecular pump and a thread groove pump connected to the turbomolecular pump; and wherein the gas inlet mixes the second gas with the first gas in one of the turbomolecular pump and the thread groove pump.

12. A vacuum pump, comprising: an inlet port into which a first gas is pumped from a chamber to be evacuated; a discharge port for discharging the gas; a gas feed section for pumping the first gas from the chamber through the inlet port and out the outlet port; a gas inlet for inputting a variable amount of a second gas into the vacuum pump to be mixed with the first gas; and a pressure regulator for regulating a pressure within the chamber to be evacuated to a desired value by controlling the amount of second gas input to the vacuum pump; wherein the gas feed section includes a turbomolecular pump and a thread groove pump connected to the turbomolecular pump; and wherein the gas inlet mixes the second gas with the first gas at a space between the turbomolecular pump and the thread groove pump.

* * * * *